US006080212A

United States Patent [19]

Beimesch et al.

[11] Patent Number: 6,080,212

[45] Date of Patent: Jun. 27, 2000

[54] LUBRICANTS FOR DIESEL FUEL

[75] Inventors: Bruce J. Beimesch, Crescent Springs, Ky.; Eugene R. Zehler, West Chester, Ohio

[73] Assignee: Henkel Corporation, Gulph Mills, Pa.

[21] Appl. No.: 08/748,455

[22] Filed: Nov. 13, 1996

[51] Int. Cl.[7] ..... C10L 1/18

[52] U.S. Cl. ..... 44/388; 44/389; 44/397; 44/398

[58] Field of Search ..... 44/388, 389, 397, 44/398

[56] References Cited

U.S. PATENT DOCUMENTS

| | | | |
|---|---|---|---|
| 3,429,817 | 2/1969 | Furey | 44/398 |
| 3,672,854 | 6/1972 | Rosenwald | 44/389 |
| 4,920,691 | 5/1990 | Fainman | 44/389 |
| 5,004,478 | 4/1991 | Vogel et al. | 44/398 |
| 5,378,249 | 1/1995 | Morrison | 44/388 |
| 5,599,358 | 2/1997 | Giarazzi et al. | 44/388 |

FOREIGN PATENT DOCUMENTS

| | | |
|---|---|---|
| WO 9417160 | 8/1994 | WIPO . |
| WO 96/23855 | 8/1996 | WIPO . |

OTHER PUBLICATIONS

P.J. Flory, The Principles of Polymer Chemistry, Cornell Univ. Press, 1953, Chapter III, "Molecular Size and Chemical Reactivity; Principles of Condensation Polymerization", pp. 69–105.

S. Herbstman, "Diesel Additives to Improve Fuel Quality", Lubrication, vol. 76 No. 2, 1990, pp. 1–12.

"Lubricity Problems of Low–Sulfur Diesel Fuel", Fuel Tech Report in Fuels & Lubes International, May 1996, pp. 12–13.

D. Cooper, "Laboratory Screening Tests for Low Sulphur Diesel Fuel Lubricity," Lubrication Science 7–2, Jan. 1995, pp. 133–148.

B. Wilson, "Fuel Lubricity", Industrial Lubrication and Tribology, vol. 48 No. 1, Jan./Feb. 1996, pp. 10–14.

P.D. Liberio & J. M. Garver, "Lubricity of Military Jet Fuels", Lubrication Engineering, vol. 51, 6 (Jun. 1995), pp. 467–473.

*Primary Examiner*—Jacqueline V. Howard
*Assistant Examiner*—Cephia D. Toomer
*Attorney, Agent, or Firm*—John E. Drach; Steven J. Trzaska

[57] ABSTRACT

Diesel fuels, particularly low sulfur diesel fuels, contain additives which increase the lubricity in the fuel and reduce the amount of smoke in the exhaust. These additives are esters having a viscosity of 3.0 cSt to 20.0 cSt at 100° C. and a smoke index of at least 75.

110 Claims, No Drawings

LUBRICANTS FOR DIESEL FUEL

BACKGROUND OF THE INVENTION

1. Field of the Invention

The present invention relates to diesel fuels, particularly low sulfur diesel fuels, containing additives which increase the lubricity while reducing the amount of smoke in the exhaust from diesel engines.

2. Description of the Related Art

The risk to human health and the environment because of diesel exhaust has been of increasing concern since the 1960's. These concerns came to a head in the late 1980's when Sweden took the first steps to address one of the major causes of automotive diesel exhaust emissions by imposing a tax on diesel fuel having a sulfur content of greater than 0.1%. Since 1993, environmental legislation in the U.S. has required that sulfur content of diesel fuel be less than 0.05%. The reduction in the sulfur content of diesel fuel has resulted in lubricity problems. It has become generally accepted that the reduction in sulfur is also accompanied by a reduction in polar oxygenated compounds and polycyclic aromatics including nitrogen-containing compounds which are responsible for the reduced boundary lubricating ability of severely refined (low sulfur) fuels. While low sulfur content is not in itself a lubricity problem, it has become the measure of the degree of refinement of the fuel and thus reflects the level of the removal of polar oxygenated compounds and polycyclic aromatics including nitrogen-containing compounds.

Low sulfur diesel fuels have been found to increase the sliding adhesive wear and fretting wear of pump components such as rollers, cam plate, coupling, lever joints and shaft drive journal bearings.

Thus, it would be desirable to increase the lubricity of diesel fuels by incorporating lubricity additives. It would also be advantageous if these additives would not increase and preferably decrease the amount of smoke and particulate content in the exhaust of diesel engines.

SUMMARY OF THE INVENTION

The present invention encompasses diesel fuels, particularly low sulfur diesel fuels, containing additives which increase the lubricity and reduce the amount of smoke in the exhaust from diesel engines. The additives according to the invention are esters that fall into two general categories. These are: (1) a mixture of two esters wherein the first type of ester has a viscosity 2 cSt or less at 100° C.; a flash point 200° C. or less (Cleveland Open Cup); and 20 or fewer carbon atoms and the second type of ester has a viscosity such that when it is mixed with the first type of ester the resulting mixture has a viscosity of from 3.0 cSt to 20.0 cSt at 100° C. as determined under ASTM D445 and a smoke index of at least 75 as determined by the JASO M 342-92 test; (2) one or more complex esters selected from the group consisting of: (a) linear oligoesters having a molecular weight of 3000 Daltons or less; (b) a complex, non-hindered polyester wherein the polyol component is a molecule having one or more beta hydrogen atoms; (c) a complex, non-hindered polyester wherein the polyol component is a non-hindered polyol having at least 3 OH groups; (d) an ester wherein the polyol component is a hindered polyol and the carboxylic acid components is a mono-carboxylic acid or a polycarboxylic acid and mixtures thereof.

DESCRIPTION OF THE PREFERRED EMBODIMENTS

It is understood that some of the carbon chain lengths of the carboxylic acids and/or esters disclosed herein are average numbers. This reflects the fact that some of the carboxylic acids and/or esters are derived from naturally occurring materials and therefore contain a mixture of compounds the major component of which is the stated compound. For example, a carboxylic having 12 carbon atoms derived from coconut oil is composed primarily of from 45% to 55% by weight of a $C_{12}$ carboxylic acid, from 15% to 23% by weight of a $C_{14}$ carboxylic acid, from 8% to 11% by weight of a $C_{16}$ carboxylic acid, from 1% to 10% by weight of a $C_{18}$ carboxylic acid, from 1% to 14% by weight of a combination of $C_8$ and $C_{10}$ carboxylic acids, and from 1% to 8% by weight of a $C_{18:1}$ carboxylic acid.

The term smokeless as used herein refers to a smoke index rating of at least 75 in the JASO M 342-92 test, the published test procedure of which is incorporated herein by reference.

The term low sulfur diesel fuel refers to any diesel grade fuel that has been chemically and/or physically modified so that the sulfur content is equal to or less than about 0.1% by weight.

The surprising discovery has been made that certain types of esters are useful as additives for diesel fuels, particularly low sulfur diesel fuels, for increasing the lubricity of the fuels while not adding to the amount of smoke in the exhaust from diesel engines. The additives according to the invention may actually decrease the amount of smoke in the exhaust from diesel engines.

The additives according to the invention may also be biodegradable as determined by Co-ordinating European Counsel standard test method L-33-A-94 (Biodegradability of Two-Stroke Cycle Outboard Gasoline engine oils in water, abbreviated C.E.C L-33-A-94), the most commonly used biodegradability test for two-cycle engine lubricants.

The additives according to the invention fall into two general categories. These are: (1) a mixture of two esters wherein the first type of ester has a viscosity 2 cSt or less at 100° C.; a flash point 200° C. or less (Cleveland Open Cup); and 20 or fewer carbon atoms and the second type of ester has a viscosity such that when it is mixed with the first type of ester the resulting mixture has a viscosity of from 3.0 cSt to 20.0 cSt at 100° C. as determined under ASTM D-445 and a smoke index of at least 75 as determined by the JASO M 342-92 test; (2) one or more complex esters selected from the group consisting of: (a) linear oligoesters having a molecular weight of 3000 Daltons or less; (b) a complex, non-hindered polyester wherein the polyol component is a molecule having one or more beta hydrogen atoms; (c) a complex, non-hindered polyester wherein the polyol component is a non-hindered polyol having at least 3 OH groups; (d) an ester wherein the polyol component is a hindered polyol and the carboxylic acid components is a mono-carboxylic acid or a polycarboxylic acid and mixtures thereof.

The first category of additives according to the invention can be any combination of at least two esters. The first type of ester is characterized as one or more esters having a viscosity of 2 cSt or less at 100° C.; a flash point 200° C. or less (Cleveland Open Cup); and 20 or fewer carbon atoms. Examples of such esters include but are not limited to isodecyl nonanoate and methyl octadecenoate (methyl oleate). The second type of ester is characterized as one or more esters having a viscosity such that when it is mixed with the first type of ester the resulting mixture has a viscosity of from 3.0 cSt to 20.0 cSt at 100° C. as determined under ASTM D-445 and a smoke index of at least 75 as determined by the JASO M 342-92 test. The second type of ester can be any ester that will form a mixture having a viscosity of from 3.0 cSt to 20.0 cSt at 100° C. and a smoke index of at least 75 as described above. Such esters can be simple esters or complex esters. Simple esters are esters of monools and mono-carboxylic acids while complex esters can be polyol esters such as pentaerythritol tetra octadecenoate or polymeric esters such as linear oligoesters having a molecular weight of 3000 Daltons or less; complex, non-hindered polyesters wherein the polyol component is a molecule having one or more beta hydrogen atoms; complex, non-hindered polyesters according to the invention are those containing a non-hindered polyol having at least 3 OH groups; and/or esters wherein the polyol component is a hindered polyol and the carboxylic acid component is a mono-carboxylic acid or a polycarboxylic acid. The ester mixture can contain more than two esters as long as the resulting mixture has a viscosity of from 3.0 cSt to 20.0 cSt at 100° C. and a smoke index of at least 75. Preferred ester mixtures are listed in Table 1 below.

The second general category of additives is comprised of four types of complex esters. This group is comprised of one or more of: (a) linear oligoesters having a molecular weight of 3000 Daltons or less; (b) complex, non-hindered polyesters wherein the polyol component is a molecule having one or more beta hydrogen atoms; (c) complex, non-hindered polyester according to the invention are those containing a non-hindered polyol having at least 3 OH groups; (d) esters wherein the polyol component is a hindered polyol and the carboxylic acid component is a mono-carboxylic acid or a polycarboxylic acid and mixtures of (a) through (d).

The first type of complex ester includes linear oligoesters having a molecular weight of 3000 Daltons or less. The oligomers according to the invention can be comprised of any combination of difunctional alcohols and dicarboxylic acids and also containing either a monool or a monocarboxylic acid as a chain stopper. Such oligomers can be made by the classical condensation or step-growth polymerization methods well known to those skilled in the art and described, for example, in pages 69-105 of The Principles of Polymer Chemistry, P. J. Flory, Cornell University Press, 1953. Preferred oligomers include the oligoester comprised of dipropylene glycol-azelaic acid-isononanoic acid; the oligoester comprised of dipropylene glycol-adipic acid-isononanoic acid; and the oligoester comprised of dipropylene glycol-azelaic acid-2-ethylhexanol. Most preferred oligomers are the oligoester comprised of dipropylene glycol-azelaic acid-nonanoic acid (mole ratio 2/1/2 respectively); the oligoester comprised of dipropylene glycol-adipic acid-nonanoic acid (mole ratio 2/1/2 respectively); and the oligoester comprised of diethylene glycol-azelaic acid-nonanoic acid (mole ratio 2/1/2 respectively).

The second type of complex ester includes complex, non-hindered polyesters. Non-hindered polyesters are those in which the polyol component is a molecule having one or more beta hydrogen atoms. A beta hydrogen atom is a hydrogen atom bonded to a carbon atom which is adjacent to a carbon atom bonded to a functional group. In the case of a polyol, a beta hydrogen is a hydrogen atom bonded to a carbon atom which is adjacent to a carbon atom bonded to an alcohol functionality. An example of a polyol having two beta hydrogen atoms is 1,3-propanediol. Glycerol is an example of a polyol having a total of five beta hydrogen atoms. Trimethylolpropane, on the other hand, has no beta hydrogen atoms. One type of complex, non-hindered polyester according to the invention are those containing a non-hindered polyol having at least 3 OH groups, a polycarboxylic acid having at least 2 carboxyl groups and a mono-carboxylic acid. The polyol/polycarboxylic acid mole ratio is equal to from about 0.1/1.0 to about 4/1.2 and preferably to about 4/1 and the polymer chains are terminated with mono-carboxylic acids which are used as chain stoppers. The polyester has a kinematic viscosity of from about 3.0 cSt to about 20.0 cSt at 100° C., a pour point of less that about 0° C., and a smoke index of at least 75. Preferred complex, non-hindered polyesters of this type are those containing glycerin as the non-hindered polyol having at least 3 OH groups, adipic acid as the polycarboxylic acid having at least 2 carboxyl groups and heptanoic acid as the mono-carboxylic acid.

The third type of complex ester includes complex, non-hindered polyesters. Non-hindered polyesters are those which are comprised of a polyol component which is a non-hindered polyol having at least 3 OH groups, a polycarboxylic acid component which is a polycarboxylic acid having at least 2 carboxyl groups, a monocarboxylic acid component and a monool component. The polyol/polycarboxylic acid mole ratio is equal to from about 0.1/1.0 to about 1/1 and the polymer chains are terminated with monools and mono-carboxylic acids which are used as chain stoppers. Preferred complex, non-hindered polyesters of this type are those containing glycerin as the non-hindered polyol having at least 3 OH groups, adipic acid as the polycarboxylic acid having at least 2 carboxyl groups and nonanoic acid and octanol as the mono-carboxylic acid and monool chain terminators. Preferred non-hindered polyol having at least 3 OH groups are those having from 3 to 10 carbon atoms. Preferred polycarboxylic acid having at least 2 carboxyl groups are those having from 2 to 54 carbon atoms. Preferred mono-carboxylic acid chain stopper are those having from 5 to 20 carbon atoms. Preferred monool chain stoppers are those having from 2 to 20 carbon atoms. Particularly preferred complex, non-hindered polyesters include such oligoesters as those comprised of glycerine-adipic acid-nonanoic acid/octanol (mole ratio-1/2/1/2) and glycerine-adipic acid-heptanoic acid/hexanol (mole ratio-1/2/1/2).

The fourth type of complex ester includes esters wherein the polyol component is a hindered polyol and the carboxylic acid component is a mono-carboxylic acid or a polycarboxylic acid. Preferred esters of this type include dipentaerythritol ester of pentanoic acid, trimethylolpropane-isotridecanol-adipic acid, and trimethylolpropane tristearate.

It is also within the present invention to use a single ester as the additive according to the invention. In the case of such a single component system, the ester will have a smoke index of greater than 75 but may have a viscosity below 2 cSt at 100° C. which may be below the viscosity requirements for 2-cycle engines. Examples of such esters are isononyl isononanoate, dimethyl azelate and polyol esters of monocarboxylic acids such as glyceryl triisostearate and glyceryl trioctadecenoate.

The diesel fuels according to the invention may also contain other additives typically used in conventional diesel fuels such as those described in Lubrication, Vol. 76 (#2), 1–12 (1990), the entire contents of which are incorporated herein by reference. Examples of such additives include, but are not limited to, cetane improvers such as 2-ethylhexyl nitrate, nitro and nitroso compounds, peroxides hydroperoxides, straight chain ethers in amounts up to about 1000 ppm. Stability additives such as 2,6-di-t-butyl4-methylphenol; N-n-butyl-p-aminophenol; p,p'-dioctyldiphenylamine; N,N'-di-sec-butyl-p-phenylenediamine; N,N-dimethyl cyclohexylamine imidazolines; long chain alkyl dimethylamines in amounts from 10 to 300 ppm. Metal deactivators such as N,N'-disalicylidene-1,2-propane diamine; N-salicylidene-hexane amine; propyl gallate; benzotriazole in amounts from 10 to 300 ppm. Dispersants/detergents such as alkenyl or polyisobutylene succinimides or polyethylene amines; polyetheramine carbamates; asparagine derivatives in amounts from 10 to 300 ppm. Corrosion inhibitors such as alkenyl succinic acids and their amine salts; carboxylic acids and their amine salts in amounts from 3 to 17 ppm. Biocides such as isothiazolone derivatives dioxaborinanes (borates) in amounts from 150 to 300 ppm. Antifoam agents such as 2-ethylhexyl acrylates; polydimethylsilicone; fluorosilicones; polyethylene glycol ethers in amounts from 1 to 30 ppm. Demulsifiers such as polyoxyethylene polymers; polyoxypropylene polymers; dodecenyl succinic anhydride esters or half esters; ethoxylated/propoxylated phenols in amounts from 1 to 5 ppm. Typically, the foregoing additives will be incorporated in the diesel fuel compositions described herein in an amount from about 50 to about 5000 ppm, and more preferably from about 80 to about 300 ppm based on the total weight of the fuel composition. Various other additives may be incorporated in the diesel fuel compositions of the invention, as desired such as smoke-suppression agents, such as polybutene or polyisobutylene, extreme pressure additives, such as dialkyldithiophosphoric acid salts or esters, anti-foaming agents, such as silicone oil, pour point depressants, such as polymethacrylate. Certain of these additives may be multifunctional, such as polymethacrylate, which may serve as an anti-foaming agent, as well as a pour point depressant. Other additives which may also be employed include rust prevention agents, oxidation inhibitors and hydrocarbon diluents.

The diesel fuels compositions according to the invention can be prepared by simply mixing the additives described herein with a diesel fuel using any standard type of mixing equipment.

The following examples are meant to illustrate but not to limit the invention.

EXAMPLE 1

Preparation of Trimethylolpropane Triisononanoate 691 grams (5.16 moles) of trimethylolpropane, 2809 grams (17.78 moles) of isononanoic acid were combined in the reactor and heated to about 230° C. to carry out the esterification of the ingredients. After the water of reaction which is continually removed began to slow at 230° C., about 26" of vacuum was added to assist in the dehydration of the ester. After four and a half hours of reaction time had passed, the temperature was about 235° C. and the analysis of the ester was an Acid Value (AV) of 48.4 and Hydroxyl Value (OH) of 24.5. After six hours of reaction time had passed, analysis of the reaction mix was made and showed the AV=41.8 and OH=5.14. After six hours of reaction time the contents were stripped and then filtered to isolate the crude ester product. The product was caustic refined (NaOH), and dried and filtered to yield the finished ester with the following properties:

| | |
|---|---|
| Acid Value, mgs KOH/gm of sample | 0.05 |
| Hydroxyl Value, mgs KOH/gm of sample | 2.15 |
| Viscosity at 40° C., centistokes | 52.79 |
| Viscosity at 100° C., centistokes | 7.13 |
| Viscosity Index | 91 |
| Flash Point, ° F. | 450 |
| Fire Point, ° F. | 525 |
| Cloud Point, ° F. | clear at pour point |
| Pour Point, ° F. | −35 |

EXAMPLE 2

Preparation of Trimethylolpropane Tristearate

The preparation of trimethylolpropane tristearate was carried out by reacting 1800 grams (1.00 equivalents) of stearic acid with 300 grams (1.035 equivalents) of trimethylolpropane. There was a slight excess of the polyol used to drive this reaction because of the difficulty in removing the high molecular weight stearic acid by vacuum stripping. The reaction vessel was equipped as described in Example 5 and the reaction was successfully carried out at 240–260° C. Water of reaction was removed and high vacuum was used to help drive the reaction to completion. The crude ester had an acid value of 2.1 and hydroxyl value of less than 14. The crude ester was refined using a chemical treatment of Cardura E which is a glycidyl ester. About 12 grams of Cardura E were added to the crude ester at 239° C. and held for 2 hours. The excess Cardura E was stripped at 239° C. for about 1 hour. The product was cooled and filtered. The final ester properties were as follows:

| Trimethylolpropane tristearate | |
|---|---|
| Acid Value | 0.085 |
| Hydroxyl Value | 9.92 |
| Viscosity at 100° C., cst. | 11.67 |
| Pour Point, ° F. | solid at room temperature |
| Flash Point, ° F. | 600 |
| Fire Point, ° F. | 645 |
| Color % Transmission 440/550 nm. | 76/96 |

EXAMPLE 3

Preparation of Di-Isotridecyltrimethyladipate

Di-isotridecyltrimethyladipate was prepared by reacting 986 grams (1.00 equivalents) of trimethyladipic acid with 2414 grams (1.15 equivalents) of isotridecyl alcohol. The vessel was similar to that previously described. The reaction was carried out at 225–230° C. while removing water of reaction. When the rate of water of removal slowed, low vacuum was applied to help continue the reaction to an acid value of 10.9. The ester was then slowly stripped of excess alcohol by applying full vacuum of about 2 Torr. The crude ester had an acid value of 6.2 and hydroxyl value of 2.0. The crude ester was then alkali refined and filtered to yield the following finished ester properties:

| Di-isotridecyltrimethyladipate | |
|---|---|
| Acid Value | 0.016 |
| Hydroxyl Value | 5.21 |
| Viscosity at 40° C., cst. | 36.96 |
| Viscosity at 100° C., cst. | 5.95 |
| Viscosity Index | 104 |
| Pour Point, ° F. | −50 |
| Flash Point, ° F. | 465 |
| Fire Point, ° F. | 520 |
| Color % Transmission at 440/550 nm. | 5/45 |

EXAMPLE 4

Preparation of Isononylisononanoate

The preparation of isononylisononanoate was carried out by charging 1660 grams (1.00 equivalents) isononanoic acid and 1740 grams (1.15 equivalents) of isononyl alcohol into a 5-liter 4-neck glass reaction vessel. The vessel is equipped with agitation and a column to condense and remove water of reaction while returning the excess alcohol back to the reaction vessel. The reaction was carried out at about 230° C. until the acid value of the preparation was a 5.0 and then the ester was stripped of excess alcohol until the hydroxyl value was 0.7. The crude ester at this point had an acid value of 1.5. The crude ester was alkali refined with NaOH to remove the trace amounts of acidity and then filtered through a filter aid. The final analysis is as follows:

| Isononylisononanoate | |
|---|---|
| Acid Value | 0.006 |
| Hydroxyl Value | 0.84 |
| Viscosity at 40° C., cSt. | 4.61 |
| Viscosity at 100° C., cSt. | 1.64 |
| Viscosity at −40° C., cSt. | 221 |
| Pour Point, ° F. | <−95 |
| Flash Point, ° F. | 310 |
| Fire Point, ° F. | 340 |
| Color % Transmission at 440/550 nm. | 100/100 |

EXAMPLE 5

Preparation of a Complex, Non-Hindered Polyester

A 5-liter, 4-neck glass reaction vessel equipped with agitation and a column to condense and remove water of reaction while returning the excess alcohol back to the reaction vessel and a nitrogen inlet were charged with 160.2 grams of glycerine (1.74 moles), 508.5 grams of adipic acid (3.48 moles), 278.6 grams of pelargonic acid (1.76 moles) and, 452.7 grams of octyl alcohol (4.00 moles). The contents of the flask were heated to 230° C. and water was removed until the acid number reached 7.3 and the hydroxyl number reached 7.1. The reaction product was alkali-refined to decrease the acid number to 0.31. The final product specs were: acid number 0.31; hydroxyl number—10.46; visc.@40° C.—52.56 cSt; visc.@100° C.—10.26 cSt; Viscosity Index—187; Flash Point—210° C.; Fire Point—224° C.; Pour Point—−21° C.

EXAMPLE 6

Preparation of a Linear Oligoester

A 5-liter, 4-neck glass reaction vessel equipped with agitation and a column to condense and remove water of reaction while returning the excess alcohol back to the reaction vessel and a nitrogen inlet were charged with 480 grams of dipropylene glycol (3.58 moles), 344.6 grams of azelaic acid (1.83 moles). The contents of the flask were heated to 225° C. and water was removed until the acid number reached 4.8 and the hydroxyl number reached 59.2 at which time 660.6 grams of pelargonic acid (4.17 moles) were added and the heating and water removal were continued until acid number reached 28.4 and the hydroxyl number reached 8.4. Excess acid and water were removed until the acid number reached 7.2 and the hydroxyl number reached 6.7. The reaction product was alkali-refined to decrease the acid number to 0.10. The final product specs were: acid number—0.10; hydroxyl number—9.95; visc.@40° C.—41.28 cSt; visc.@100° C.—8.08 cSt; Viscosity Index—173; Flash Point—252° C.; Fire Point—263° C.; Pour Point—−54° C.

TABLE 1

| I.D.[1] | Visc.[2] | Pour Point[3] (° C.) | Flash Point[4] (° C.) | Smoke Index[5] | Biodegr[6] |
|---|---|---|---|---|---|
| 2911 | 1.7 | −73 | 171 | 74 | >95 |
| 2873 | 160 | −9 | 293 | 81 | 60 |

TABLE 1-continued

| I.D.[1] | Visc.[2] | Pour Point[3] (° C.) | Flash Point[4] (° C.) | Smoke Index[5] | Biodegr[6] |
|---|---|---|---|---|---|
| 2873/2911(33/67) | 7.9 | −59 | 168 | 120 | 69 |
| 2301 | 1.7 | −18 | 182 | 78 | >95 |
| 2873/2301(34/66) | 8 | −23 | 182 | 92 | |
| 2898 | 12.4 | −23 | 320 | 90 | >95 |
| 2898/2911(79/21) | 8 | −37 | 199 | 92 | |
| 2898/2301(80/20) | 8 | −34 | 210 | 86 | |
| 3528-8 | 1.6 | −73 | 154 | 176 | |
| 2898-3528-8 (79/21) | 8 | −32 | 199 | 105 | |
| 2983 | 223 | −18 | 243 | 39 | 73 |
| 2983/2911(27/73) | 8 | −62 | 182 | 86 | |
| 2983-3528-8 (27/73) | 8 | −62 | 157 | 180 | |
| 2914 | 1.2 | −7 | 149 | 181 | |
| 2983/2914(30/70) | 8 | −5 | 146 | 209 | |
| 3588-4 | 9.3 | −43 | 218 | 86 | |
| 3588-9 | 8.5 | −37 | 224 | 77 | |
| 3588-13 | 7.4 | −15 | 243 | 91 | |
| 3588-19 | 9.2 | −48 | 252 | 90 | >95 |
| 3588-33 | 10.3 | −21 | 210 | 108 | |
| 3589-1A | 8 | −59 | 185 | 113 | 91 |
| 3589-1B | 8 | −23 | 188 | 88 | |
| TMP-05-320 | 44.5 | −34 | 332 | 92 | 91 |
| 3528-61 | 8.1 | −54 | 252 | 90 | >95 |
| 3528-69 | 6.9 | −65 | 252 | 72 | |
| 3528-76 | 7.1 | −51 | 249 | 85 | >95 |
| 3528-79 | 7.4 | −48 | 254 | 54 | |

[1]-2911 - isodecyl nonanoate
2873 - dimer acid ester of diethylene glycol
2301 - methyl octadecenoate
2898 - pentaerythritol tetra octadecenoate
3528-8 - isononyl isononanoate
2914 - dimethyl azelate
2983 - dimer acid ester of neopentylglycol and propylene glycol
3588-4 - oligoester of dipropylene glycol-azelaic acid-isononanoic acid (mole ratio-2/1/2)
3588-9 - oligoester of dipropylene glycol-adipic acid-isononanoic acid (mole ratio-2/1/2)
3588-13 - oligoester of diethylene glycol-azelaic acid-nonanoic acid (mole ratio-2/1/2)
3588-19 - oligoester of glycerine-adipic acid-heptanoic acid (mole ratio-2/1/4)
3588-33 - oligoester of glycerine-adipic acid-nonanoic acid/octanol (mole ratio-1/2/1/2)
3589-1A - TMP-05-320/2911 (48/52)
3589-1B - TMP-05-320/2301 (49/51)
TMP-05-320 - complex ester trimethylolpropane-dimer acid-octadecenoic acid
3528-61 - oligoester of dipropylene glycol-azelaic acid-nonanoic acid (mole ratio-2/1/2)
3528-69 - oligoester of dipropylene glycol-azelaic acid-2-ethylhexanol (mole ratio-1/2/2)
3528-76 - oligoester of dipropylene glycol-adipic acid-nonanoic acid (mole ratio-2/1/2)
3528-79 - oligoester of dipropylene glycol-adipic acid-isodecyl alcohol (mole ratio-1/2/2)
[2]-ASTM D-445 (cSt. @ 100° C.)
[3]-ASTM D-97
[4]-ASTM D-92
[5]-JASO M-342-92
[6]-C.E.C L-33-A-94

What is claimed is:

1. A composition comprising diesel fuel and an additive comprising: (a) a first ester having a viscosity of about 2 cSt or less at 100° C., a flash point of 200° C. or less, and 20 carbon atoms or less selected from the group consisting of isodecyl nonanoate, methyl octacecenoated, isononyl isononanoate and mixtures thereof; (b) a second ester having a viscosity such that when said second ester is mixed with said first ester the resulting additive has a viscosity of from about 3.0 cSt to about 20.0 cSt at 100° C. and a smoke index of at least 75.

2. The composition of claim 1 wherein said first ester is isodecyl nonanoate.

3. The composition of claim 1 wherein said first ester is methyl octadecenoate.

4. The composition of claim 1 wherein said first ester is isononyl isononanoate.

5. The composition of claim 1 wherein said second ester is a dimer acid ester of diethylene glycol.

6. The composition of claim 1 wherein said second ester is pentaerythritol tetra octadecenoate.

7. The composition of claim 1 wherein said second ester is a complex ester of trimethylolpropane-dimer acid-octadecenoic acid.

8. The composition of claim 1 further comprising an additive selected from the group consisting of cetane improvers, stability additives, metal deactivators, dispersants/detergents, corrosion inhibitors, biocides, anti-foaming agents, demulsifiers, and smoke-suppression agents.

9. A composition comprising diesel fuel and an additive comprising one or more esters selected from the group consisting of: (a) a linear oligoester having a molecular weight of 3000 Daltons or less selected from the group consisting of dipropylene glycol-azelaic acid-nonanoic acid, dipropylene glycol-adipic acid-nonanoic acid, diethylene glycol-azelaic acid-nonanoic, a dimer acid ester of diethylene glycol, and mixtures thereof; (b) a complex, non-hindered polyester prepared from a polyol having at least 3 OH groups and one or more beta hydrogen atoms, a polycarboxylic acid having at least 2 carboxyl groups and a mono-carboxylic acid; (c) a complex, non-hindered polyester prepared from a non-hindered polyol having at least 3 OH groups, a polycarboxylic acid having at least 2 carboxyl groups, a mono-carboxylic acid and a monool; (d) an ester selected from the group consisting of dipentaerythritol ester of pentanoic acid, trimethylolpropane tristerate, pentaerythritol tetraoctadecenoate, a complex ester of trimethylolpropane-dimer acid-octadecenoic acid, a complex ester of trimethylolpropane-isotridecanol-adipic acid, and mixtures thereof.

10. The composition of claim 9 wherein said oligoester is the oligoester comprised of dipropylene glycol-azelaic acid-nonanoic acid.

11. The composition of claim 9 wherein said oligoester is the oligoester comprised of dipropylene glycol-adipic acid-nonanoic acid.

12. The composition of claim 9 wherein said oligoester is the oligoester comprised of diethylene glycol-azelaic acid-nonanoic acid.

13. The composition of claim 9 wherein said oligoester is a dimer acid ester of diethylene glycol.

14. The composition of claim 9 further comprising an additive selected from the group consisting of cetane improvers, stability additives, metal deactivators, dispersants/detergents, corrosion inhibitors, biocides, anti-foam agents, demulsifiers and combinations thereof.

15. The composition of claim 9 where said complex ester (b) is a complex, non-hindered polyester containing a polyol component having one or more beta hydrogen atoms, a polycarboxylic acid having at least 2 carboxyl groups and a mono-carboxylic acid wherein said polyester has a kinematic viscosity of from about 3.0 cSt to about 20.0 cSt at 100° C., a pour point of less than about 0° C. and, a smoke index of at least 75.

16. The composition of claim 15 wherein the polyol/polycarboxylic acid mole ratio is equal to from about 0.1/1.0 to about 4/1.

17. The composition of claim 15 wherein said polyol is glycerin, said polycarboxylic acid is adipic acid and said monocarboxylic acid is heptanoic acid.

18. The composition of claim 15 further comprising an additive selected from the group consisting of cetane improvers, stability additives, metal deactivators, dispersants/detergents, corrosion inhibitors, biocides, anti-foaming agents, demulsifiers, and smoke-suppression agents.

19. The composition of claim 9 where said complex ester (a) is a complex, non-hindered polyester containing a non-hindered polyol component having at least 3 OH groups, a polycarboxylic acid having at least 2 carboxyl groups, a monocarboxylic acid, and a monool wherein said polyester has a kinematic viscosity of from about 3.0 cSt to about 20.0 cSt at 100° C., a pour point of less than about 0° C. and, a smoke index of at least 75.

20. The composition of claim 19 wherein the polyol/polycarboxylic acid mole ratio is equal to from about 0.1/1.0 to about 1/1.

21. The composition of claim 19 wherein said polycarboxylic acid has at least 2 carboxyl groups and from 2 to 54 carbon atoms and said monool has from 2 to 20 carbon atoms.

22. The composition of claim 19 wherein said complex, non-hindered polyester is a polyester of glycerine-adipic acid-nonanoic acid/octanol in a mole ratio of 1/2/1/2 respectively.

23. The composition of claim 19 wherein said complex, non-hindered polyester is a polyester of glycerine-adipic acid-heptanoic acid/hexanol in a mole ratio of 1/2/1/2 respectively.

24. The composition of claim 19 further comprising an additive selected from the group consisting of cetane improvers, stability additives, metal deactivators, dispersants/detergents, corrosion inhibitors, biocides, anti-foaming agents, demulsifiers, and smoke-suppression agents.

25. The composition of claim 9 wherein said ester (d) is dipentaerythritol ester of pentanoic acid.

26. The composition of claim 9 wherein said ester (d) is trimethylolpropane tristearate.

27. The composition of claim 9 wherein said ester (d) is pentaerythritol tetra octadecenoate.

28. The composition of claim 9 wherein said ester (d) is a complex ester of trimethylolpropane-dimer acid-octadecenoic acid.

29. The composition of claim 9 wherein said ester (d) is a complex ester of trimethylolpropane-isotridecanol-adipic acid.

30. The composition of claim 9 further comprising an additive selected from the group consisting of cetane improvers, stability additives, metal deactivators, dispersants/detergents, corrosion inhibitors, biocides, anti-foaming agents, demulsifiers, and smoke-suppression agents.

31. A method for increasing the lubricity of a diesel fuel which comprises adding to said diesel fuel a lubricating-effective amount of an additive which is comprised of: (a) a first ester having a viscosity of about 2 cSt or less at 100° C., a flash point of 200° C. or less, and 20 carbon atoms or less selected from the group consisting of isodecyl nonanoate, methyl octadecenoate, isononyl isononanoate, and mixtures thereof; (b) a second ester having a viscosity such that when said second ester is mixed with said first ester the resulting ester base stock has a viscosity of from about 3.0 cSt to about 20.0 cSt at 100° C. and a smoke index of at least 75.

32. The method of claim 31 wherein said first ester is isodecyl nonanoate.

33. The method of claim 31 wherein said first ester is methyl octadecenoate.

34. The method of claim 31 wherein said first ester is isononyl isononanoate.

35. The method of claim 31 wherein said second ester is a dimer acid ester of diethylene glycol.

36. The method of claim 31 wherein said second ester is pentaerythritol tetra octadecenoate.

37. The method of claim 31 wherein said second ester is a complex ester of trimethylolpropane-dimer acid-octadecenoic acid.

38. The method of claim 31 further comprising an additive selected from the group consisting of cetane improvers, stability additives, metal deactivators, dispersants/detergents, corrosion inhibitors, biocides, antifoaming agents, demulsifiers, and smoke-suppression agents.

39. A method for increasing the lubricity of a diesel fuel which comprises adding to said diesel fuel a lubricating-effective amount of an additive which is comprised of one or more esters selected from the group consisting of: (a) a linear oligoester having a molecular weight of 3000 Daltons or less selected from the group consisting of dipropylene glycol-azelaic acid-nonanoic acid, dipropylene glycol-adipic acid-nonanoic acid, diethylene glycol-azelaic acid-nonanoic acid, and mixture thereof; (b) a complex, non-hindered polyester prepared from a polyol having at least 3 OH groups and on or more beta hydrogen atoms, a polycarboxylic acid having at least 2 carboxyl groups and a mono-carboxylic acid; (c) a complex, non-hindered polyester wherein the polyol component is a non-hindered polyol having at least 3 OH groups; (d) an ester selected from the group consisting of dipentaerythritol ester of pentanoic acid, trimethylolpropane tristearate, pentaerythritol tetraoctadencenoate, a complex ester of trimethylolpropane-dimer acid-octadecenoic acid, a complex ester of trimethylolpropane-isotridecanol-adipic acid, and mixtures thereof.

40. The method of claim 39 wherein said oligoester is the oligoester comprised of dipropylene glycol-azelaic acid-nonanoic acid.

41. The method of claim 39 wherein said oligoester is the oligoester comprised of dipropylene glycol-adipic acid-nonanoic acid.

42. The method of claim 39 wherein said oligoester is the oligoester comprised of diethylene glycol-azelaic acid-nonanoic acid.

43. The method of claim 39 wherein said oligoester is a dimer acid ester of diethylene glycol.

44. The method of claim 39 further comprising an additive selected from the group consisting of extreme pressure additives, anti-foaming agents, pour point depressants, rust or corrosion prevention agents, oxidation inhibitors, detergent, dispersants, smoke-suppression agents, and hydrocarbon diluents.

45. The method of claim 39 where said complex ester (b) is a complex, non-hindered polyester containing a polyol component having one or more beta hydrogen atoms, a polycarboxylic acid having at least 2 carboxyl groups and a mono-carboxylic acid wherein said polyester has a kinematic viscosity of from about 3.0 cSt to about 20.0 cSt at 100° C., a pour point of less than about 0° C. and, a smoke index of at least 75.

46. The method of claim 45 wherein the polyol/polycarboxylic acid mole ratio is equal to from about 0.1/1.0 to about 4/1.

47. The method of claim 45 wherein said polyol is glycerin, said polycarboxylic acid is adipic acid and said monocarboxylic acid is heptanoic acid.

48. The method of claim 45 further comprising an additive selected from the group consisting of cetane improvers, stability additives, metal deactivators, dispersants/detergents, corrosion inhibitors, biocides, antifoaming agents, demulsifiers, and smoke-suppression agents.

49. The method of claim 39 where said complex ester (c) is a complex, non-hindered polyester containing a non-hindered polyol component having at least 3 OH groups, a polycarboxylic acid having at least 2 carboxyl groups, a monocarboxylic acid, and a monool wherein said polyester has a kinematic viscosity of from about 3.0 cSt to about 20.0 cSt at 100° C., a pour point of less than about 0° C. and, a smoke index of at least 75.

50. The method of claim 49 wherein the polyol/polycarboxylic acid mole ratio is equal to from about 0.1/1.0 to about 1/1.

51. The method of claim 49 wherein said polycarboxylic acid has at least 2 carboxyl groups and from 2 to 54 carbon atoms and wherein said ester further comprises a monool having from 2 to 20 carbon atoms.

52. The method of claim 49 wherein said complex, non-hindered polyester is a polyester of glycerine-adipic acid-nonanoic acid/octanol in a mole ratio of 1/2/1/2 respectively.

53. The method of claim 49 wherein said complex, non-hindered polyester is a polyester of glycerine-adipic acid-heptanoic acid/hexanol in a mole ratio of 1/2/1/2 respectively.

54. The method of claim 39 wherein said ester (d) is dipentaerythritol ester of pentanoic acid.

55. The method of claim 39 wherein said ester (d) is trimethylolpropane tristearate.

56. The method of claim 39 wherein said ester (d) is pentaerythritol tetra octadecenoate.

57. The method of claim 39 wherein said ester (d) is a complex ester of trimethylolpropane-dimer acid-octadecenoic acid.

58. The method of claim 39 wherein said ester (d) is a complex ester of trimethylolpropane-isotridecanol-adipic acid.

59. The method of claim 49 further comprising an additive selected from the group consisting of cetane improvers, stability additives, metal deactivators, dispersants/detergents, corrosion inhibitors, biocides, antifoaming agents, demulsifiers, and smoke-suppression agents.

60. In a diesel engine comprising fuel having improved lubricity, the improvement wherein said fuel comprises diesel fuel and an additive comprised of: (a) a first ester having a viscosity of about 2 cSt or less at 100° C., a flash point of 200° C. or less, and 20 carbon atoms or less selected from the group consisting of isodesyl nonanoate, methyl octadecenoate, isononyl isononanoate and mixtures thereof; (b) a second ester having a viscosity such that when said second ester is mixed with said first ester the resulting ester mixture has a viscosity of from about 3.0 cSt to about 20.0 cSt at 100° C. and a smoke index of at least 75.

61. The diesel engine of claim 60 wherein said first ester is isodecyl nonanoate.

62. The diesel engine of claim 60 wherein said first ester is methyl octadecenoate.

63. The diesel engine of claim 60 wherein said first ester is isononyl isononanoate.

64. The diesel engine of claim 60 wherein said second ester is a dimer acid ester of diethylene glycol.

65. The diesel engine of claim 60 wherein said second ester is pentaerythritol tetra octadecenoate.

66. The diesel engine of claim 60 wherein said second ester is a complex ester of trimethylolpropane-dimer acid-octadecenoic acid.

67. The diesel engine of claim 60 further comprising an additional additive selected from the group consisting of cetane improvers, stability additives, metal deactivators, dispersants/detergents, corrosion inhibitors, biocides, antifoaming agents, demulsifiers, and smoke-suppression agents.

68. In a diesel engine comprising fuel having improved lubricity, the improvement wherein said fuel comprises diesel fuel and an additive comprised of one or more esters selected from the group consisting of: (a) a linear oligoester having a molecular weight of 3000 Daltons or less selected from the group consisting of dipropylene glycol-azelaic acid-nonanoic acid, dipropylene glycol-adipic acid-nonanoic acid, diethylene glycol-azelaic acid-nonanoic, a dimer acid ester of diethylene glycol, and mixtures thereof; (b) a complex, non-hindered polyester prepared from a polyol having at least 3 OH groups and one or more beta hydrogen atoms, a polycarboxylic acid having at least 2 carboxyl groups and a mono-carboxylic acid; (c) a complex, non-hindered polyester prepared from a non-hindered polyol having at least 3 OH groups, a polycarboxylic acid having at least 2 carboxyl groups, a mono-carboxylic acid and a monool; (d) an ester selected from the group consisting of dipentaerythritol ester of pentanoic acid, trimethylolpropane tristerate, pentaerythritol tetraoctadecenoate, a complex ester of trimethylolpropane-dimer acid-octadecenoic acid, a complex ester of trimethylolpropane-isotridecanol-adipic acid, and mixtures thereof.

69. The diesel engine of claim 68 wherein said oligoester is the oligoester comprised of dipropylene glycol-azelaic acid-nonanoic acid.

70. The diesel engine of claim 68 wherein said oligoester is the oligoester comprised of dipropylene glycol-adipic acid-nonanoic acid.

71. The diesel engine of claim 68 wherein said oligoester is the oligoester comprised of diethylene glycol-azelaic acid-nonanoic acid.

72. The diesel engine of claim 68 wherein said oligoester is a dimer acid ester of diethylene glycol.

73. The diesel engine of claim 68 further comprising an additive selected from the group consisting of cetane improvers, stability additives, metal deactivators, dispersants/detergents, corrosion inhibitors, biocides, anti-foaming agents, demulsifiers, and smoke-suppression agents.

74. The diesel engine of claim 68 where said complex ester (b) is a complex, non-hindered polyester containing a polyol component having one or more beta hydrogen atoms, a polycarboxylic acid having at least 2 carboxyl groups and a mono-carboxylic acid wherein said polyester has a kinematic viscosity of from about 3.0 cSt to about 20.0 cSt at 100° C., a pour point of less than about 0° C. and, a smoke index of at least 75.

75. The diesel engine of claim 74 wherein the polyol/polycarboxylic acid mole ratio is equal to from about 0.1/1.0 to about 4/1.

76. The diesel engine of claim 74 wherein said polyol is glycerin, said polycarboxylic acid is adipic acid and said monocarboxylic acid is heptanoic acid.

77. The diesel engine of claim 68 where said complex ester (c) is a complex, non-hindered polyester containing a non-hindered polyol component having at least 3 OH groups, a polycarboxylic acid having at least 2 carboxyl groups a monocarboxylic acid, and a monool wherein said polyester has a kinematic viscosity of from about 3.0 cSt to about 20.0 cSt at 100° C., a pour point of less than about 0° C. and, a smoke index of at least 75.

78. The diesel engine of claim 77 wherein the polyol/polycarboxylic acid mole ratio is equal to from about 0.1/1.0 to about 1/1.

79. The diesel engine of claim 77 wherein said polycarboxylic acid has at least 2 carboxyl groups and from 2 to 54 carbon atoms and said monool has from 2 to 20 carbon atoms.

80. The diesel engine of claim 77 wherein said complex, non-hindered polyester is a polyester of glycerine-adipic acid-nonanoic acid/octanol in a mole ratio of 1/2/1/2 respectively.

81. The diesel engine of claim 77 wherein said complex, non-hindered polyester is a polyester of glycerine-adipic acid-heptanoic acid/hexanol in a mole ratio of 1/2/1/2 respectively.

82. The diesel engine of claim 77 further comprising an additive selected from the group consisting of extreme pressure additives, anti-foaming agents, pour point depressants, rust or corrosion prevention agents, oxidation inhibitors, detergent, dispersants, smoke-suppression agents, and hydrocarbon diluents.

83. The diesel engine of claim 68 wherein said ester (d) is dipentaerythritol ester of pentanoic acid.

84. The diesel engine of claim 68 wherein said ester (d) is trimethylolpropane tristearate.

85. The diesel engine of claim 68 wherein said ester (d) is pentaerythritol tetra octadecenoate.

86. The diesel engine of claim 60 further comprising an additive selected from the group consisting of extreme pressure additives, anti-foaming agents, pour point depressants, rust or corrosion prevention agents, oxidation inhibitors, detergent, dispersants, smoke-suppression agents, and hydrocarbon diluents.

87. A diesel fuel composition which is the product of the process comprising mixing diesel fuel and an additive comprised of: (a) a first ester having a viscosity of about 2 cSt or less at 100° C., a flash point of 200° C. or less, and 20 carbon atoms or less selected from the group consisting of isodecyl nonanoate, methyl octadecenoate, isononyl isononanoate and mixtures thereof; and; (b) a second ester having a viscosity such that said additive has a viscosity of from about 3.0 cSt to about 20.0 cSt at 100° C. and a smoke index of at least 75.

88. The composition of claim 87 wherein said first ester is isodecyl nonanoate.

89. The composition of claim 87 wherein said first ester is methyl octadecenoate.

90. The composition of claim 87 wherein said first ester is isononyl isononanoate.

91. The composition of claim 87 wherein said second ester is a dimer acid ester of diethylene glycol.

92. The composition of claim 87 wherein said second ester is pentaerythritol tetra octadecenoate.

93. The composition of claim 87 wherein said second ester is a complex ester of trimethylolpropane-dimer acid-octadecenoic acid.

94. The composition of claim 87 further comprising an additive selected from the group consisting of extreme pressure additives, anti-foaming agents, pour point depressants, rust or corrosion prevention agents, oxidation inhibitors, detergent, dispersants, smoke-suppression agents, and hydrocarbon diluents.

95. A diesel fuel composition which is the product of the process comprising mixing diesel fuel and an additive made by the process of reacting a dicarboxylic acid and a diol in the presence of a monocarboxylic acid or a dicarboxylic acid to form a linear oligoester having a molecular weight of 3000 Daltons or less selected from the group consisting of dipropylene glycol-azelaic acid-nonanoic acid, dipropylene glycol-adipic acid-nonanoic acid, diethylene glycol-azelaic acid-nonanoic, a dimer acid ester of diethylene glycol, and mixtures thereof.

96. The composition of claim 95 wherein said oligoester is the oligoester comprised of dipropylene glycol-azelaic acid-nonanoic acid.

97. The composition of claim 95 wherein said oligoester is the oligoester comprised of dipropylene glycol-adipic acid-nonanoic acid.

98. The composition of claim 95 wherein said oligoester is the oligoester comprised of diethylene glycol-azelaic acid-nonanoic acid.

99. The composition of claim 95 wherein said oligoester is a dimer acid ester of diethylene glycol.

100. The composition of claim 95 further comprising an additive selected from the group consisting of cetane improvers, stability additives, metal deactivators, dispersants/detergents, corrosion inhibitors, biocides, anti-foaming agents, demulsifiers, and smoke-suppression agents.

101. A diesel fuel composition which is the product of the process comprising mixing diesel fuel and a compound which is the product of the process comprising reacting a polyol having one or more beta hydrogen atoms and at least 3 OH groups, a polycarboxylic acid having at least 2 carboxyl groups and a mono-arboxylic acid wherein said compound has a kinematic viscosity of from about 3.0 cSt to about 20.0 cSt at 100° C., a pour point of less than about 0° C. and, a smoke index of at least 75.

102. The composition of claim 101 wherein the polyol/polycarboxylic acid mole ratio is equal to from about 0.1/1.0 to about 4/1.

103. The composition of claim 101 wherein said polyol is glycerin, said polycarboxylic acid is adipic acid and said monocarboxylic acid is heptanoic acid.

104. The composition of claim 101 further comprising an additive selected from the group consisting of extreme pressure additives, anti-foaming agents, pour point depressants, rust or corrosion prevention agents, oxidation inhibitors, detergent, dispersants, smoke-suppression agents, and hydrocarbon diluents.

105. A diesel fuel composition which is the product of the process comprising mixing diesel fuel and an additive which is the product of the process comprising reacting a non-hindered polyol having at least 3 OH groups, a polycarboxylic acid having at least 2 carboxyl groups, a monocarboxylic acid, and a monool wherein said product is a non-hindered polyester having a kinematic viscosity of from about 3.0 cSt to about 20.0 cSt at 100° C., a pour point of less than about 0° C. and, a smoke index of at least 75.

106. The composition of claim 105 wherein the polyol/polycarboxylic acid mole ratio is equal to from about 0.1/1.0 to about 1/1.

107. The composition of claim 105 wherein said polycarboxylic acid has at least 2 carboxyl groups and from 2 to 54 carbon atoms and said monool has from 2 to 20 carbon atoms.

108. The composition of claim 105 wherein said complex, non-hindered polyester is a polyester of glycerine-adipic acid-nonanoic acid/octanol in a mole ratio of 1/2/1/2 respectively.

109. The composition of claim 105 wherein said complex, non-hindered polyester is a polyester of glycerine-adipic acid-heptanoic acid/hexanol in a mole ratio of 1/2/1/2 respectively.

110. The composition of claim 105 further comprising an additive selected from the group consisting of cetane improvers, stability additives, metal deactivators, dispersants/detergents, corrosion inhibitors, biocides, anti-foaming agents, demulsifiers, and smoke-suppression agents.

* * * * *